US006686841B1

(12) United States Patent
Busch et al.

(10) Patent No.: US 6,686,841 B1
(45) Date of Patent: Feb. 3, 2004

(54) HANGING DEVICE FOR ESTABLISHING AN ELECTRICALLY CONDUCTIVE CONTACT WITH A HANGING ARTICLE AND A MONITORING SYSTEM UTILIZING SAME

(75) Inventors: Dieter Busch, Ismaning (DE); Heinrich Lysen, Garching (DE); Miachael Hermann, Villingen (DE)

(73) Assignee: Pruftechnik Dieter Busch AG, Ismaning (DE)

( * ) Notice: Subject to any disclaimer, the term of this patent is extended or adjusted under 35 U.S.C. 154(b) by 0 days.

(21) Appl. No.: 09/450,513

(22) Filed: Nov. 30, 1999

(30) Foreign Application Priority Data

| | | |
|---|---|---|
| Nov. 30, 1998 | (DE) | 198 55 201 |
| Apr. 16, 1999 | (DE) | 299 06 910 U |
| Jun. 15, 1999 | (DE) | 299 10 440 U |

(51) Int. Cl.[7] ..... G08B 13/14

(52) U.S. Cl. ..... 340/571; 340/568.1; 340/568.8; 340/687; 340/693.9

(58) Field of Search ..... 340/568.1, 568.2, 340/568.8, 687, 693.5, 693.9, 693.11, 686.1

(56) References Cited

U.S. PATENT DOCUMENTS

| | | | | |
|---|---|---|---|---|
| 3,760,402 A | | 9/1973 | Magerle et al. | |
| 4,337,462 A | | 6/1982 | Lemelson | 340/568.1 |
| 5,210,846 A | | 5/1993 | Lee | |
| 5,226,137 A | | 7/1993 | Bolan et al. | |
| 5,258,743 A | | 11/1993 | Nelson et al. | |
| 5,561,417 A | * | 10/1996 | Rothbaum et al. | 340/568.1 |
| 5,764,888 A | | 6/1998 | Bolan et al. | |
| 6,122,704 A | | 9/2000 | Hass et al. | |

FOREIGN PATENT DOCUMENTS

| | | |
|---|---|---|
| DE | 297 02 473 | 7/1997 |
| DE | 198 24 587 A1 | 12/1998 |
| WO | WO 98/56182 | 12/1998 |

OTHER PUBLICATIONS

Protecting Paintings From Theft, Joseph R. Knisley, Electrical Construction and Maintenance, Feb. 1977, p. 62.

* cited by examiner

*Primary Examiner*—Daryl C. Pope
(74) *Attorney, Agent, or Firm*—Nixon Peabody LLP; David S. Safran

(57) ABSTRACT

The security system as presented is used preferredly to monitor paintings and other work of art. Essential component of the security system are suspending elements, for mounting e.g. paintings. The suspending elements also serve to transmit signals (data) or electrical power, for illumination purposes. It is preferred to implement a two wire bus system with the suspending elements. In case an alarm is triggered, the system according to the invention is able to immediately identify and display the time and the place of the objects to be guarded. Several levels of monitoring capabilities are provided, which work in cooperation with hardware consisting of different sensors or transponders. The security system in accordance with one embodiment is connectable to a network.

69 Claims, 11 Drawing Sheets

HANGING DEVICE FOR ESTABLISHING AN ELECTRICALLY CONDUCTIVE CONTACT WITH A HANGING ARTICLE AND A MONITORING SYSTEM UTILIZING SAME

BACKGROUND OF THE INVENTION

Field of the Invention

The invention relates to a monitoring system with a pertinent hanging device for hanging of articles, especially works of art, which are provided with electrical security and/or illumination means. The invention furthermore relates to monitoring units for articles of this type.

A monitoring system of the generic type is known from the article "Protecting Painting from Theft" by J. R. Kaisley, Electrical Construction and Maintenance 76 (2/1977), page 62. This is an antitheft device for displayed paintings, on the wall behind the suspended paintings metal rails being attached which are electrically interconnected via three-wire cable to the corresponding connectors, each rail for each picture having a socket into which the three-pin connector can be inserted, in order to connect a miniswitch to the three-wire system of the rail by means of a three-wire cable. Each miniswitch is attached to the back of the frame of the painting by a wood screw and an adhesive surface. In this position the circuit is closed by the switch. Any movement on the frame of the painting breaks the switch away from the frame, by which the switch is moved by means of a pretensioning spring into a position in which the circuit is broken by the switch. The three-wire system of rails is connected to an alarm unit. As soon as the alarm unit acquires an interruption of the circuit, it triggers the corresponding theft alarm. It is not detailed how the paintings are hung.

The object of this invention is to devise a monitoring system and a pertinent hanging device for hanging articles which are to be put into electrical contact, which is characterized by especially simple handling and use and which allows hanging of articles as conveniently as possible.

Another object of the invention is to configure the pertinent hanging device for hanging articles to be put into electrical contact such that it is made economically, visually attractive and user-friendly.

Another object of the invention is to devise a monitoring unit for attachment to articles to be monitored, which is made simply and practically.

Another object of the invention is to devise a monitoring system for articles such that it is reliable and user-friendly and ensures a high security standard.

These objects are achieved by a monitoring system

The hanging device in accordance with the invention is very economical, visually attractive and user-friendly. The monitoring unit in accordance with the invention can be economically produced and is still reliable. The monitoring system in accordance with the invention with comfortable operation offers a high security standard and easily provides for good sensitivity.

In the following, first the hanging device provided in the monitoring system is presented. In accordance with one embodiment it is advantageous that only a single fastening unit is necessary for hanging the articles since it already has at least two current paths and thus is suited for complete, i.e. two-pole, contact-making. Furthermore it is advantageous that because the suspended fastening elements can move and the final suspension site for a certain article can be flexibly chosen with the fastening unit permanently installed.

The fastening elements can be made such that they ensure a selection option regarding to which of the current paths the contact or each contact establishes electrical contact. This allows standard formation of each fastening element so that only a uniform basic type of fastening element is necessary.

According to one alternative embodiment of the hanging device, there can be at least two types of fastening elements which differ by the arrangement of their contacts such that in the suspended state for each type of fastening element, at least one contact makes contact with another current path.

In a first embodiment of the fastening elements in accordance with the invention the selection option is ensured by the contact-making being dependent on the orientation in which the fastening element or each fastening element is suspended in the fastening unit. This eliminates any need to adjust the fastening element to the desired type of contact-making, but simply the orientation during suspension must be chosen accordingly. In this embodiment, the contacts are feasibly attached permanently to the fastening elements. In one preferred embodiment, each fastening element is made essentially mirror-symmetrically with reference to a center plane, there being two contact configurations between which it is possible to select by turning the orientation of the fastening element by 180°.

In a second embodiment of the fastening elements in accordance with the invention, the selection option is guaranteed by there being only one type of contact and by the fact that each contact before suspension of the fastening element can be used at different locations of the fastening element in order to determine the current path with which contact is to be made. In this case, the basic type of fastening element is adjusted before use to the desired contact configuration.

Alternatively, according to a third embodiment, the selection option can be achieved by there being at least two types of contacts and the contacts before suspension of the fastening element being inserted at a certain location of the fastening element, the choice of contact types determining the current path with which contact is to be made.

Alternatively, according to a fourth embodiment, the selection option can be achieved by there being only a single type of fastening unit, a single type of contact and only a single type of fastening element, and contact can be made as desired by specific location of the contact and fastening element on the fastening unit.

The fastening unit is preferably made rail-like, and it can comprise a profile part which partially encompasses an interior and each current path is made as a busbar which is applied to the profile part in the interior, the profile part being made preferably to be electrically insulating. The contacts are preferably made as brush springs.

The profile part in a first embodiment is preferably made channel-shaped with three essentially closed sides and with one side which has been provided with a through, elongated opening, the fastening elements having the capacity to be suspended by means of the opening in the profile part.

Alternatively, the profile part can be made channel-shaped with three sides, it being attachable by its back to one wall, the front being essentially open and the top being provided with a first slot and the bottom being provided with a second slot, and the fastening elements with their top end can be suspended in the first slot and can be engaged in the second slot by their bottom end.

Preferably, there are diaphragm parts which can be inserted into the opening or the open side of the profile part and which are provided preferably with contacts to make contact with the current paths and with electronic means which are conductively connected to these contacts.

Alternatively to the rail-like configuration of the fastening unit, the contacts can be made such that they are used to suspend the fastening elements in the fastening unit. In doing so, the fastening unit preferably comprises several holding elements which are to be attached stationary in a row and at least two parallel tubular or rod-shaped current leads, the current leads being held by the holding elements. The contacts are made such that they can be suspended in one of the current leads. Preferably, for each contact there is a correspondingly made insulated auxiliary element which can be suspended in one of the current leads. In this embodiment, the selection option of the contact configuration is achieved by the contact configuration depending on the orientation of the fastening element during suspension.

Preferably, each fastening element has an eye for suspending a hanging element which is connected to the article to be hung and which is conductively connected to the contact or to each contact. The hanging elements are preferably made as electrically conductive cables or chains. The articles to be hung are preferably works of art which are provided with electrical security and/or illumination means. The current paths are connected to a power source and/or a control unit in order to establish electrical contact between the power source and/or the control unit and the corresponding security and/or illumination means on the works of art via the hanging device.

In the following, several embodiments of the invention are detailed by way of example using the attached drawings.

DETAILED DESCRIPTION OF THE INVENTION

Figure 1:
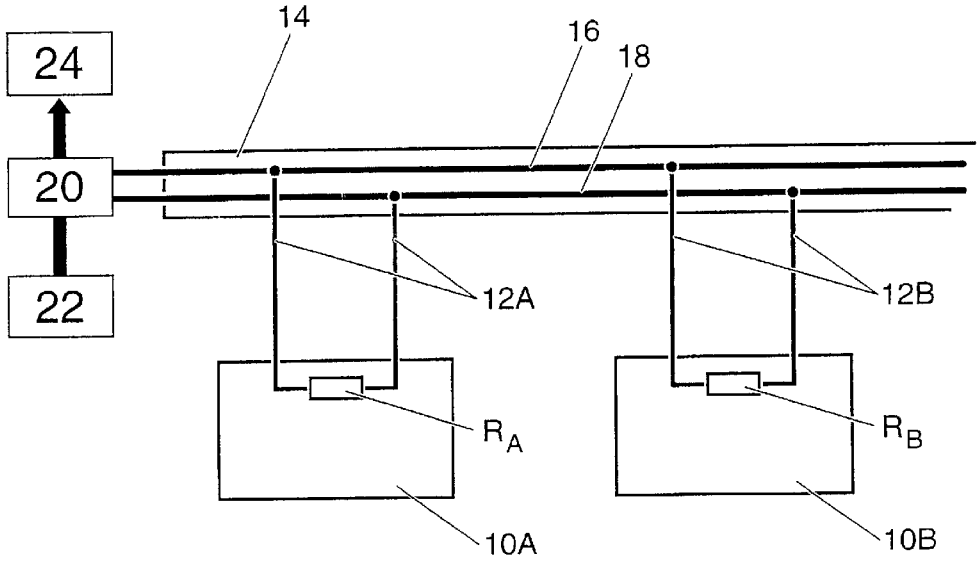
FIGS. 1 to 4 each schematically show different security or illumination systems for the suspended works of art.

The monitoring device which is shown in FIG. 1 is used to monitor pictures 10A, 10B which are suspended on cables 12A, 12B in an exhibition space. Each picture 10A, 10B is provided on its back with a resistor RA and RB respectively which are each conductively connected to the cables 12A and 12B. An individual resistance value is assigned to each picture 10A, 10B in order to differentiate the pictures for the monitoring device. To the wall or to the ceiling of the exhibition space, a rail 14 is attached which is provided with two through current paths 16 and 18 which are each connected to a control unit 20 which is supplied with power by a power source 22. Cables 12A, 12B are made as electrical conductors, preferably as metal cables and with their one end, they are each connected to one of the current paths 16 and 18 in order to provide for an electrical connection between the control unit 20 and the respective resistor RA and RB. The resistors RA and RB are thus located in a parallel electrical circuit, the control unit acquiring the current through the overall loop which has been formed by the parallel connection and, in the case of deviations from a stipulated setpoint, send an alarm signal to an alarm means 24 which then produces an acoustic or optical warning signal. Any removal of a picture 10A, 10B by removal of at least one of the cables 12A, 12B increases the resistance in the overall loop and can thus be acquired by the control unit 20. Because each resistance value is delivered only once, the control unit 20 can determine from the acquired resistance change which of the pictures is being manipulated.

Figure 2:
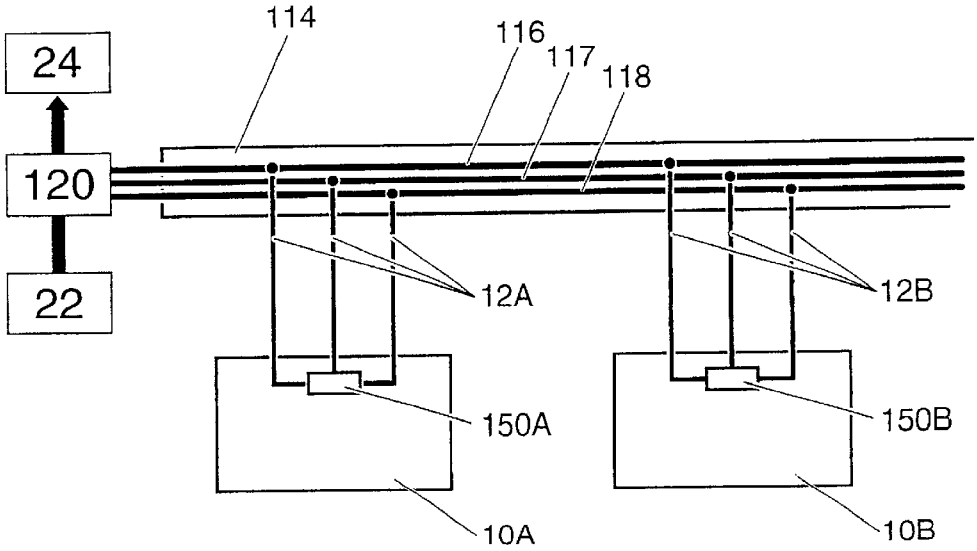

FIG. 2 schematically shows a digital form of amonitoring device, identification of each pictures 10A, 10B taking place via a logic unit 150*a*, 150*b* which is attached on the back of the picture frame and which comprises a microprocessor as an important component. In doing so, each picture 10A, 10B is identified by a digital code value which is delivered only once and which is fixed by digital memory, dip switches, wire bridges and the like on the logic unit 150*a*, 150*b*. Communications between the control unit 120 and the logic units 150*a*, 150*b* takes place via a serial three-wire bus system. The fastening rail 114 comprises three parallel current paths 116, 117, 118 for this purpose, the current path 116 being used as a ground terminal and the current paths 117 and 118 being used as the receiving and transmitting line. In order to hang the pictures 10A, 10B on the fastening rail 114 and to connect each logic unit 150*a*, 150*b* to the bus system, there are three electrically conductive cables 12A, 12B per picture. The current conductors 116, 117 and 118 can be used at the same time also as the power supply for the logic unit 50*a*, 50*b*. Alternatively, there may be one or two additional current paths and the corresponding additional cables for the power supply of the logic unit. The monitoring function is accomplished such that the control unit 120 via the bus system, i.e. the current conductors 116, 117, 118 and the cables 12A, 12B, sends signals to the logic units 150*a*, 150*b* which receive them and acknowledge them, depending on the code value assigned to the special logic unit 150*a* and 150*b*. When an acknowledgement signal is absent, the control unit 120 triggers an alarm by a corresponding alarm signal to the alarm unit 24. Since the acknowledgement function is different for each picture, the control unit 120 can recognize on which picture there is manipulation.

Figure 3:
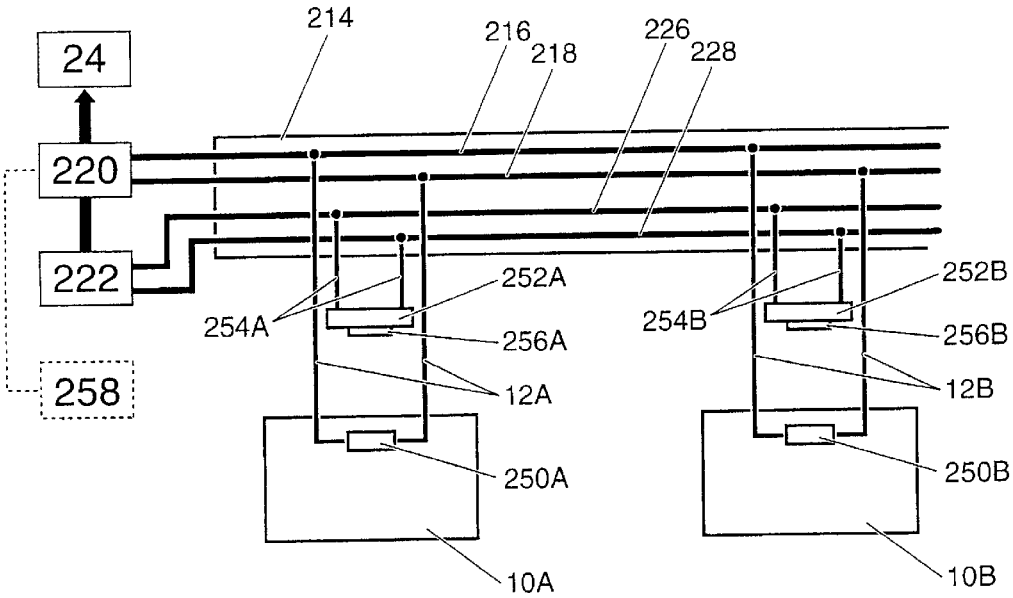

FIG. 3 shows another digital form of the monitoring device, where instead of the three-wire bus system, a simpler bidirectional two-wire bus system being used which can at the same time, also undertake power supply of the logic unit 250A, 250B. The fastening rail 214 has two current paths 216, 218 to which the electrically conductive cables 12A, 12B are connected on order to form the two-wire bus system, this bus system undertaking both data exchange between the logic units 250A, 250B and the control unit 220 and also the power supply of the logic units 250A, 250B. In addition, the fastening rail 214 has two current paths 226, 228 which are used as the power supply for the illumination elements 252A, 252B which are attached to the fastening rail 214 via each picture 10A, 10B.

The illumination elements 252A, 252B can be, for example,tubular lamps or a lightemitting diode arrangement for protection of the color pigments of the painting. Attachment and contact-making of the illumination elements 252A, 252B can take place, for example,likewise via electrically conducting cables 254A, 254B which are connected to the current paths 226,228. Depending on the type of illumination elements used, it is also conceivable for power to be supplied to the illumination elements likewise via the current paths 216, 218 provided for the bus system, so that in this case, the additional power supply paths 226, 228 can be eliminated. The illumination elements 252A, 252B can furthermore be provided with motion detectors 256A, 256B with a power supply which likewise takes place via the contact strips 226, 228 and which is connected to the control unit 220 via the current paths 216, 218 in order to report possible movements in the area of the pictures 10A, 10B to the control unit 220 which then optionally sends an alarm signal to the alarm unit 23. The motion detectors 256A, 256B can work optically or capacitively. By means of the motion detectors 256A, 256B a prewarning function can also be accomplished to indicate when a person or an article is approaching too near the pictures 10A, 10B. The motion detectors 256A, 256B can also be used to turn on the illumination elements 252A, 252B only when an individual is located in the vicinity of the corresponding picture 10A, 10B in order on the one hand to save energy, and on the other hand, to expose the color pigments of the pictures 10A, 10B to as little light as possible.

It is also conceivable for the illumination elements 252A, 252B to be directly connected to the cables 12A, 12B for purposes of fastening and power supply such that the illumination elements 252A, 252B are not connected to the fastening rail 214.

The logic units 250A, 250B can furthermore be made such that they wirelessly effect data exchange with the control unit 220 additionally or alteratively to the use of the bus system, the logic units 250A, 250B then being made as transmitters/receivers and the control unit 220 being equipped with an additional transmitter/receiver unit 258 (shown by the broken line in FIG. 3).

Figure 4:
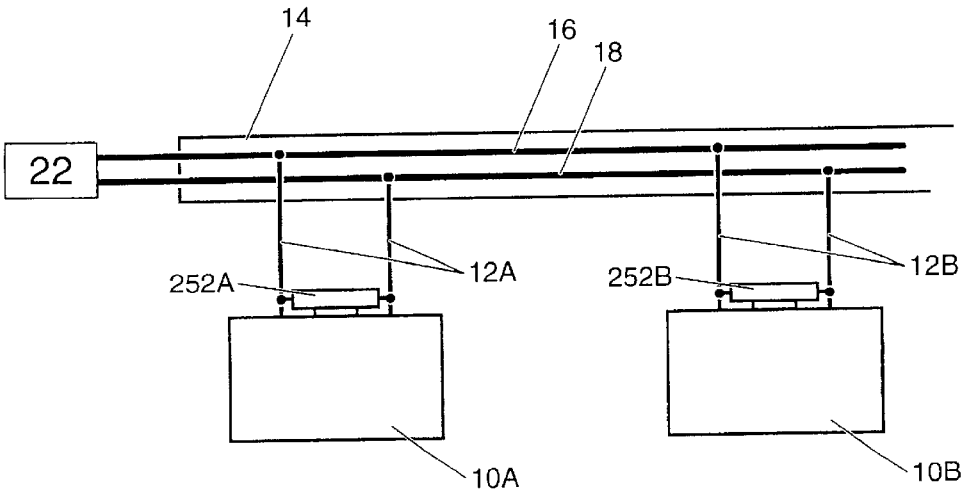

As is shown in FIG. 4, if only illumination but no monitoring of the articles is necessary, a control unit and the corresponding monitoring unit can be abandoned. In this case, the illumination elements 252A, 252B can be attached to the pictures 10A, 10B and are supplied with power via the electrically conductive hanging cables 12A, 12B of the pictures 10A, 10B which are connected to the current paths 16, 18 of the fastening rail 14 which are in turn, connected to the power source 22. The illumination elements 252A, 252B can also be made "intelligent", i.e. with power switches and decoder logic so that centrally controlled selective on/off of individual or all illumination elements is possible. The control function can be accomplished via the power supply lines or by additional control lines.

Figure 5:
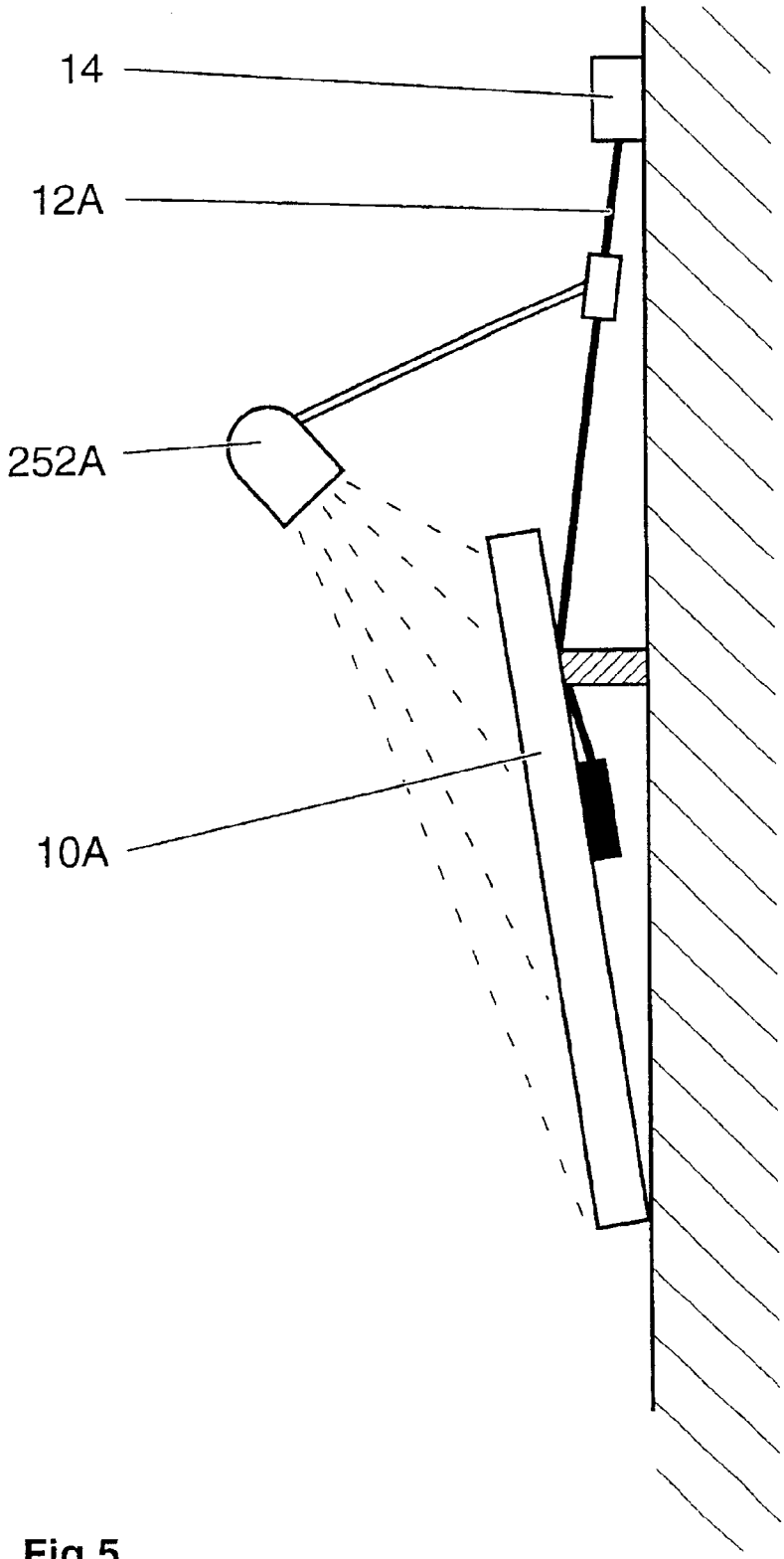
FIG. 5 illustrates a side profile view of another embodiment of a security and illumination systems for a suspended work of art.

FIG. 5 shows one alternative embodiment in which the illumination elements 252A, 252B are not attached to the pictures 10A, 10B, but directly to the hanging cables 12A, 12B. For safety reasons, the cables 12A, 12B which are used for power supply should be insulated accordingly.

In general, the electrically conductive hanging cables should be provided with external insulation for safety reasons or in the interest of operation as trouble-free as possible. Optionally, a hanging cable be provided for two electrical connection lines, for example, in the form of a coaxial or twisted pair arrangement.

In the described security/illumination systems, it is advantageous for a hanging system to be simply implemented; this allows very simple and flexible hanging, monitoring and/or illumination of pictures. These systems are suited not only for exhibited works of art, but can also be used for any articles which are to be monitored, exhibited or optionally illuminated.

The following description relates to the configuration of the fastening rails and thus to how the hanging cables or elements can be hanged in the fastening rails.

Figure 6:
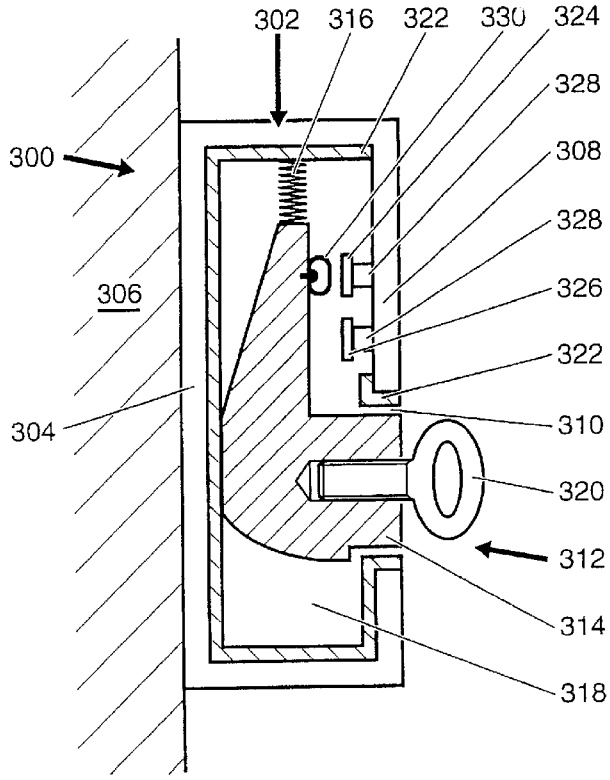
FIG. 6 shows a sectional view of a first embodiment of the hanging device in accordance with the invention.

FIG. 6 shows a first embodiment for a fastening rail with two current paths which can be used as rails 14 in the security and illumination systems which are shown in FIGS. 1 and 3. The fastening rail labelled overall with reference number 300 in FIG. 6 comprises a channel-shaped profile part 302 which is made for example, of metal and which is fastened by its back to one wall 306. The front 308 of the profile 302 is provided with an elongated through opening 310 through which or into which a fastening element 312 is hung in the profile 302. The profile 302, 314 which is pressed down by means of a compression spring 316 in the interior 318 which is surrounded by the profile 302, and a screw eye 320 which can be screwed into the body 314. The interior 318 and the opening 310 are lined with insulation 322. On the inside of the front 308, there are two busbars 324 and 326 which are located in parallel at a distance from one another and which are insulated by means of insulation 328 relative to the profile 302.

On the body 314 of the fastening element 312, there is a closed contact spring 330 which in the configuration shown as a sliding contact in FIG. 6, is in electrical contact with the top busbar 324. The body 314 and the screw eye 320 are made conductive so that the sliding contact 330 establishes electrical contact between the top busbar 324 and the screw eye 320. One of the electrically conductive hanging elements 12A, 12B can be hung in the screw eye in order to connect one pole of an electronic monitoring element of an article 10A or 10B which is to be monitored to the busbar 324. Instead of the screw eye 320, another suitable element such as a hook can be used. The fastening element 312 can basically be moved along the profile 302, the contact spring providing for electrical contact to the busbar 324 independently of the displacement position of the fastening element 312. The pressure spring 316 provides however, for a certain locking of the fastening element 312 in the respective position so that a certain force threshold must be overcome for movement of the fastening element 312.

According to a first option, the contact spring 330 can be fastened to the body 314 such that it can be adjusted by hand in its position on the body 314 before suspending the fastening element 312 in the profile in order to make contact selectively with the top busbar 324 or the bottom busbar 326 after the fastening element 314 is hung.

To do this, the contact springs can be moved on the body 314, for example, between two corresponding positions in which it can be locked. When an article 10A or 10B which is to be monitored is hung, one of the fastening elements 312 necessary for this purpose is adjusted to the configuration which is shown in FIG. 6 for the contact with the top busbar 324, while the other fastening element 312 is adjusted by the corresponding displacement of the contact spring 330 for contact with the bottom busbar 326. In this approach, it is advantageous for only one single "basic type" of fastening element 312 to be necessary which can be adjusted to the contact configuration desired at the time before hanging.

Adjustment of the fastening element 312 before hanging can be abandoned when there are two different types of fastening elements 312 which differ by the position of the attached contact springs 330 so that the respective contact configuration is fixed by the selection of the types of fastening element 312.

Figure 7:
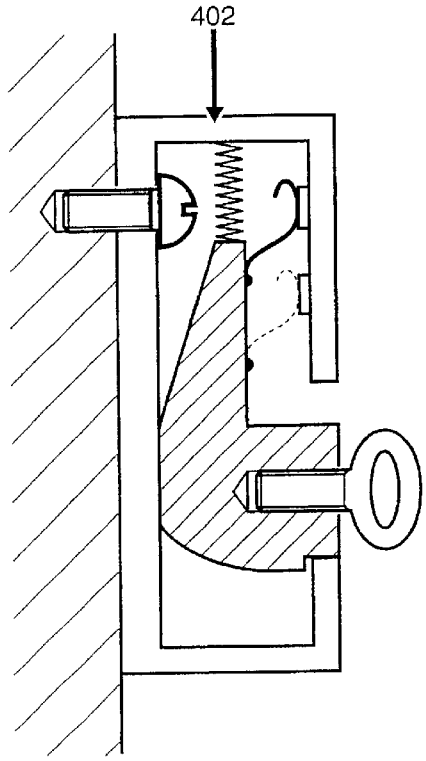
FIG. 7 shows a view similar to FIG. 6, however a modification of the first embodiment being shown with the fastening element locked.
Figure 8:
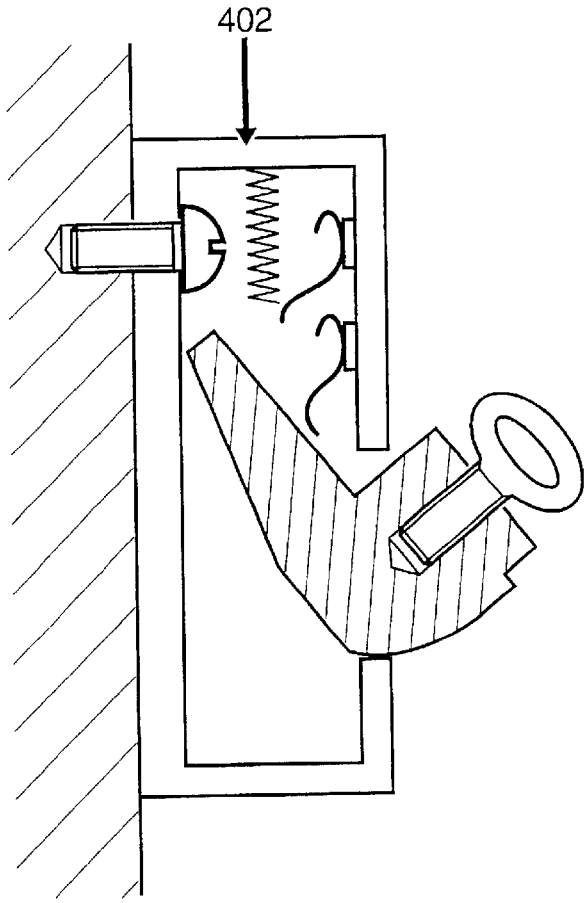
FIG. 8 shows a view similar to FIG. 7, however the fastening unit being shown when suspended or removed.

FIG. 7 shows one modification of the embodiment as shown in FIG. 6, the fastening element being shown in the suspended state. FIG. 8 shows the fastening element from FIG. 7 when it is suspended in the profile part or removed from it. The profile part 402 as shown in FIGS. 7 and 8 is made nonconductive, for example, made of plastic, by which additional insulation relative to the fastening element is not necessary. The fastening element is made in a roughly L-shape in cross section; this facilitates suspension or removal through the opening 310. In the fastening element shown in FIGS. 7 and 8, the contact springs are made lug-like in contrast to FIG. 6 and make contact with the bottom current bus.

Figure 9:
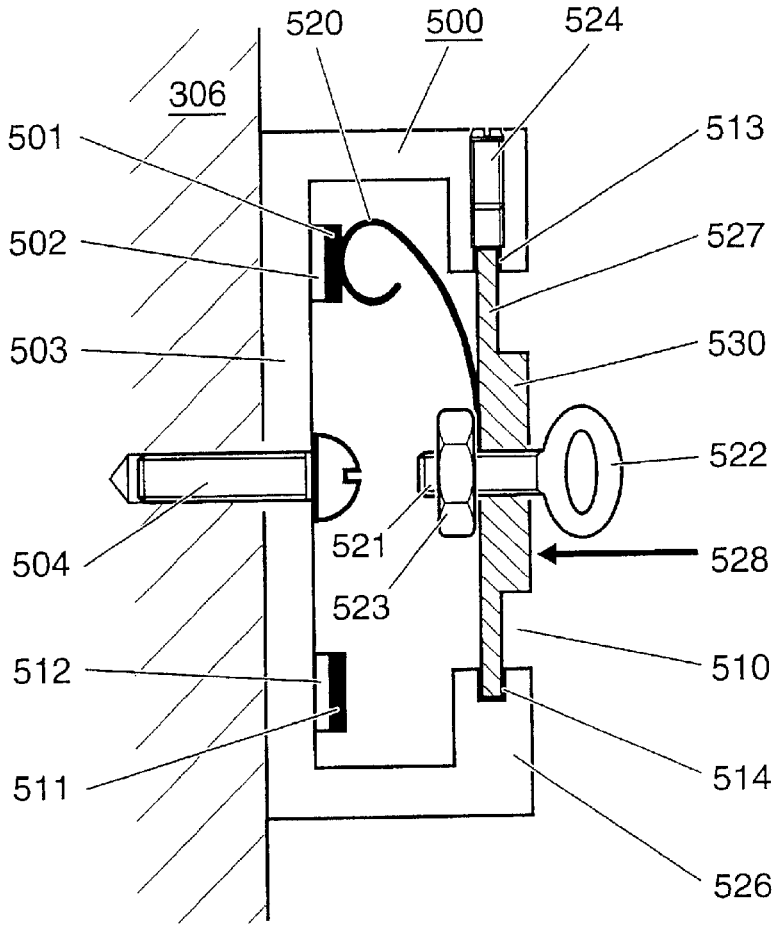
FIG. 9 shows a view similar to FIGS. 6 to 8, however a second embodiment of the hanging device being shown.

FIG. 9 shows a second embodiment of a hanging device the invention. The profile part 500 of the fastening unit is made similarly to FIGS. 6 to 8, i.e. it is attached by its back using a screw 504 to a wall 306 and on its front, has a through opening 510 which is also used to mount the screw 504. The profile 500 can be made of metal or plastic and is essentially symmetrical with respect to a center plane which runs through the screw 504. On the inside of the rear wall of the profile 500, there are a top busbar 501 and a bottom busbar 511 which are insulated relative to the profile part 50 by means of insulation 502 and 512 and which are likewise arranged symmetrically with respect to the center plane. The rear wall 503 of the profile 500 is provided with holes for screws 504 at regular intervals. The boundary edges of the opening 510 are each provided with a slot 513 or 514 which runs in the lengthwise direction of the profile 500. The fastening element 528 comprises a preferably electrically insulating body 530 which has two projections 527 and 526 which fit into the slots 513 and 514 in the suspended state of the fastening element 528 and thus provide for guidance of the suspended fastening element 528, in the lengthwise direction of the profile. To lock the fastening element 528 there is a safety lock or safety screw 524.

Insertion of the fastening element 528 into the slot is done by first loosening the safety screw 524 to the top. Slots 513 and 514 are dimensioned such that the fastening element 528 can be inserted into the slot 513 from bottom to top and then can be swivelled slightly to the rear so that it can be inserted downward into the slot 514. Afterwards, the safety screw 524 can be screwed in again so that the fastening element 528 is secured.

Figure 10:
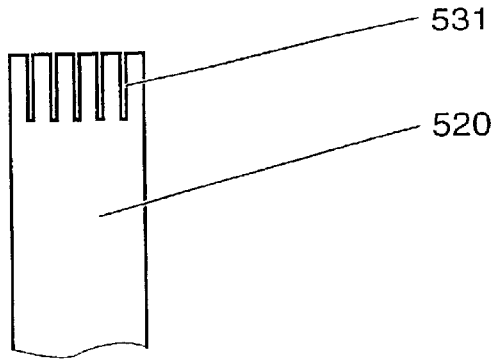
FIG. 10 shows a view of the contact springs from FIG. 9.

The slots 513 and 514 are of varied depth so that the fastening element 528 can be made symmetrical; this provides for good appearance and easier handling. A conductive screw eye 522 is routed through the body 530 and by means of a nut 523 is attached to the body 530. The nut 523 furthermore holds a contact spring 520 which in the position shown in FIG. 9, is in electrical contact with the top busbar 510 and the screw eye 522. According to FIG. 10 the contact spring 520 is provided with contact spring slots 531 in order to provide for good contact with the busbar 501. Preferably the busbars 501, 511 and the contact springs 520 are gold-plated. The fastening element 528, aside from the contact springs 520, is made mirror-symmetrical with reference to the axis which passes through the screw eye 522. The contact spring 520 is permanently, connected to the body 530. Based on the symmetrical formation of the profile 500, the busbars 501, 511 and the fastening element 528, instead of the top busbar 501, the bottom busbar 511 can be easily brought into contact with the contact spring 520 by inserting the entire fastening element 528 turned 180° into the profile 500 or the slots 513, 514. This embodiment has the advantage that there need be only a single basic type of fastening element and the user nevertheless need not undertake any adjustment processes with respect to the contact before hanging, but he can easily determine the contact configuration by choosing the orientation of the fastening element when hanging.

The body 530 of the fastening element 528 is preferably made of insulating material so that optionally, signals from the interior of the profile 500 can be sent. The fastening element 528 can also optionally be equipped with electronics and/or a battery or emergency power supply.

Figure 11:
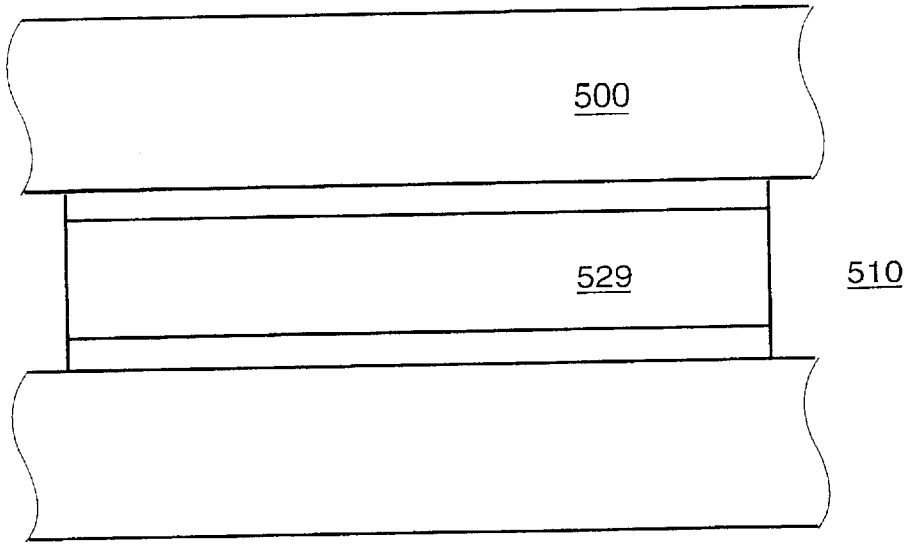
FIG. 11 shows a front view of the fastening means from FIG. 9 with the diaphragm mounted.

FIG. 11 shows a diaphragm or diaphragm strip 529 which is inserted into the slots 513, 514 of the front of the profile 500 in order to cover the opening 510. The diaphragm 529 is preferably produced from insulating material and can optionally be provided with contact springs (which are not shown) in order to make contact with the busbars 501 and 511 and to make contact with electronic means (not shown) which are provided on the diaphragm 529 or a battery holder. The diaphragm 529 is used mainly to cover those parts of the opening 510 which are not occupied by a fastening element 528. If the diaphragm is equipped with a battery holder, the inserted battery can be used for emergency power supply of the monitoring means in the case of failure of the regular power supply of the busbars 501, 511.

Figure 12:
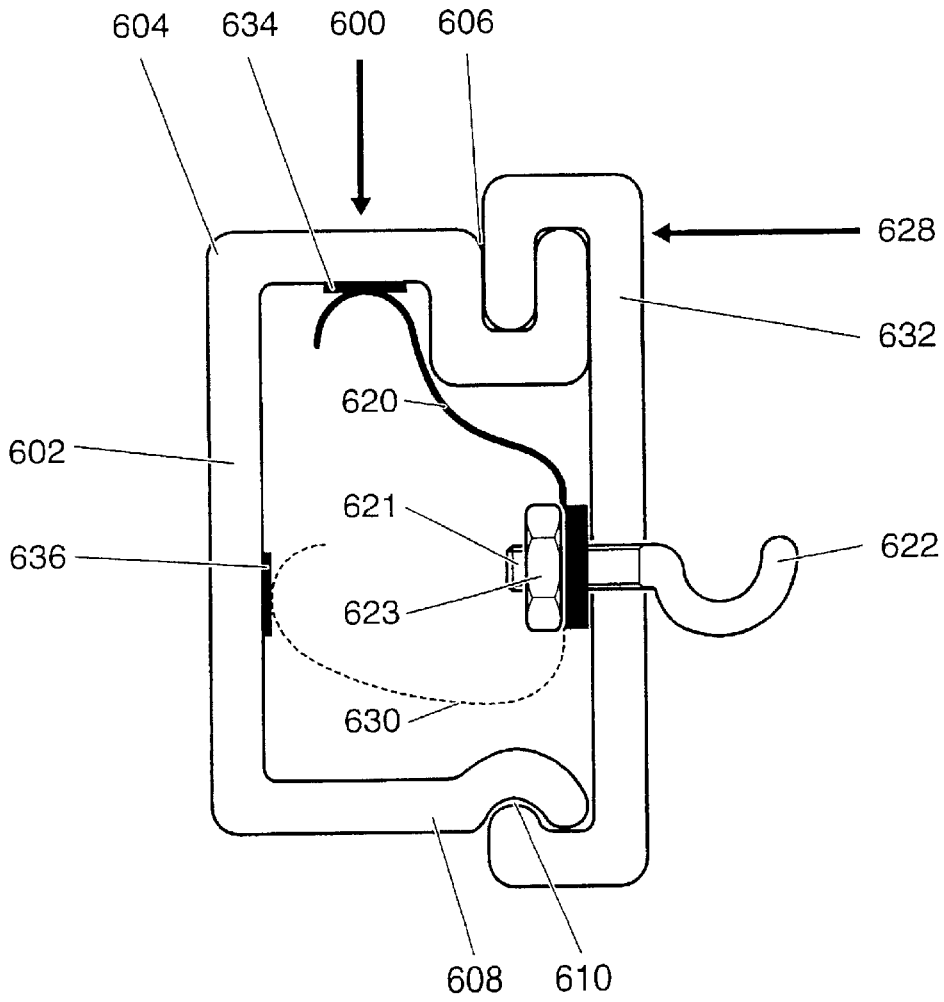
FIG. 12 shows a view similar to FIGS. 6 to 9, however a third embodiment of the hanging device being shown.

FIG. 12 shows a third embodiment of a hanging device in accordance with the invention in which the profile 600 consists preferably of plastic and is fastened to the wall 306 by its back 602. The top 604 of the profile 600 is provided with a slot 606 while the bottom 608 is provided with a slot 610. The fastening element 628 has a body 632 and a hook 622 which is routed through the body 632, and has a thread 621 on which a nut 623 is screwed in order to attach the hook to the body 632. Furthermore, the nut 623 has a spring 620 which makes contact with a busbar 634 which is provided on the inside of the top 604. The body 632 is made such that with its top end, it can be suspended in the slot 606 and with its bottom end, it can catch in the slot 610. On the inside of the back 602, here is a second busbar 636. To prepare the fastening element 622 for making contact with the second busbar 636 before hanging in the profile 600, the spring 620 can be replaced by a differently shaped spring 630 which is shown by the broken line in FIG. 12. Instead of the fastening elements 628 with a replacement function, two different types of fastening elements can be made available which each are permanently connected to a spring 620 or a spring 630, the contact-making then being established via the choice of the type of fastening element 628.

Figure 13:
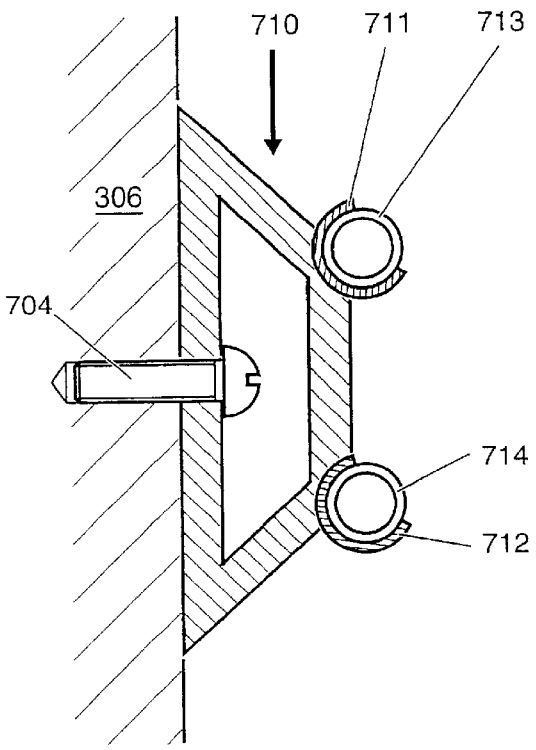
FIG. 13 from a sectional view of a fourth embodiment of the hanging device.
Figure 14:
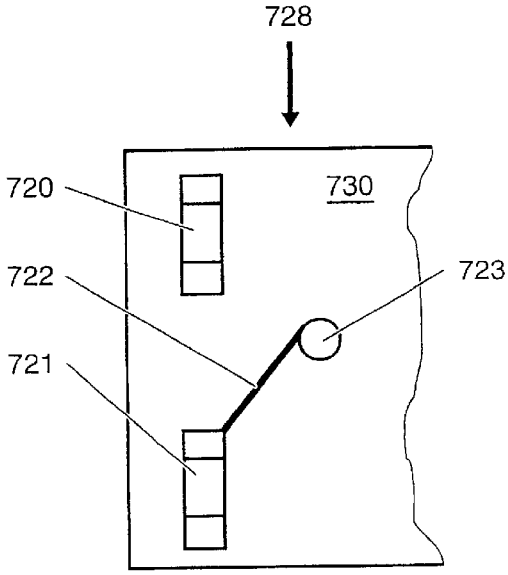
FIG. 14 shows an overhead view of a fastening element for use with the fastening means which is shown in FIG. 13.

Finally, FIGS. 13 and 14 show a fourth embodiment of a hanging device in accordance with the invention, which differs from the above described embodiments in that there is no rail-shaped or profile-shaped fastening unit, but that the fastening unit is formed by several holding elements 710 attached to the wall 306 in a row and two parallel tubular or rod-shaped current guides 713 and 714 which are held by the holding elements 710 by means of the corresponding receivers 711 and 712. To prevent the danger of short circuit, the current guides can be provided in sections with an insulating layer. The receivers 711, 712 are made such that the current guide 713, 714 can be clipped in.

FIG. 14 shows a fastening element 728 for the fastening unit shown in FIG. 13 which comprises a body 730 with a contact which is made as a conductive clip or hook 721 and a correspondingly symmetrically formed and arranged non-conductive clip or hook 720 as an auxiliary element. The contact 721 is connected by means of a connecting line 722 to a contact 723 which is routed through the body 730 and which is used for connection to a conductive hanging element 12A, 12B. The body 730 with the contact 721 and the auxiliary element 720 is made such that the contact 721 for example, can be hung in the bottom current guide 714 and the auxiliary element 720 in the top current guide 713, the contact 721 then providing for electrical contact with the bottom current guide 714. By turning the fastening element 728 by 180° the contact configuration can be reversed, i.e. the contact 721 then forms an electrical contact with the top current guide 713. It goes without saying that in FIG. 14, only one half of the fastening element 728 is shown, the half which is not shown being built symmetrically to the half which is shown.

In the above discussion only fastening elements for fastening units with two current paths have been described. But it goes without saying that the described principle can also be applied to fastening units with more than two current paths, as for example in the monitoring systems shown in FIGS. 2 and 3. In this case, the fastening elements can be made such that they can selectively make contact with one of three or four current paths (a single basic type) or there can accordingly be three or four different types of fastening elements. Furthermore, it is also possible for one fastening element to make contact with two current paths at the same time and accordingly have two terminal poles.

In a modification of the monitoring means described in FIGS. 1, 2, and 4 or in addition thereto antitheft protection for suspended articles to be monitored can also be provided by integrating a force sensor for acquiring the hanging force in at least one hanging element of a suspended article. Alternatively, the force sensor can also be integrated into the fastening element which connects the hanging element to the fastening unit. The sensor can send its measurement signal to the alarm unit which then determines that there is an alarm when a stipulated force is not reached and delivers a corresponding signal. The force sensor acts as a dynamometer and as a transponder and is preferably connected via the hanging element or elements to the corresponding current paths of the fastening rail or unit for power supply from the power source and for communication with the alarm means. Basically, the sensor however can also itself deliver an alarm signal.

Alternatively or in addition to the above described monitoring means, there can be a sensor on the article to be monitored which acquires the distance of the suspended article from the wall and delivers a signal when the distance of the suspended article from the wall departs from a stipulated tolerance range.

Alteratively, the sensor can send its distance measurement signal to the alarm unit which then determines whether there is an alarm case. The power supply of the sensor and optionally its communications take place preferably in the above described manner, i.e. via conductive hanging elements. The sensor is made as a capacitive sensor or as an optical sensor, in the latter case, it preferably sending a light beam at the wall and acquiring the reflected light.

The following is apparent from the other embodiments shown in FIGS. 15 to 18 on hanging devices or monitoring means:

The cable 1014A and 1014B on its top end is connected to a fastening element 1022A and 1022B which is hung in the fastening unit 1016 and has a contact 1024 which is in electrical contact with one of the current paths 1018 or 1020. The cables 1014A and 1014B and the fastening elements 1022A and 1022B are made electrically conductive so that the cable 1014A is electrically connected to the current path 1020 while the cable 1014B is electrically connected to the current path 1018. The fastening unit 1016 comprises a first trough-shaped part 1026 which is open to the top and comprises a base 1028 and two side walls 1030 and 1032. The side wall 1032 which is farther away from the building wall 1034 of the trough shaped first part 1026 passes upwards into a side wall 1036 of a second trough-shaped part 1038 which is open to the bottom. Next to the side wall 1036 comprises a base 1040 and a second side wall 1042 which is used to attach the fastening unit 1016 to the building wall 1034 and thus essentially adjoins 1w the building wall 1036. The current paths 1018 and 1020 are attached on the inside of the side wall 1036 or 1032. The second part 1038 forms essentially a U-shaped which is closed to the top while the first trough-shaped part 1026 forms a U-shaped which is open essentially to the top.

The fastening element 1022A and 1022B is made essentially as a U-shaped part which is open to the bottom with a base 1044 and two legs 1046 and 1048, the free end of the leg 1046 being connected to the cable 1014A or 1014B and the free end of the leg 1048 being hung in the first trough-shaped part 1026 of the fastening unit 1016 and is thus essentially supported by the base 1028. The leg 1048 on its outside also bears the contact 1024.

The fastening element 1022A and 1022B is suspended in the fastening unit 1016 by its being pushed from underneath through the intermediate space between the side wall 1042 of the second trough-shaped part 1038 and the side wall 1030 of the trough-shaped first part 1026 until the leg 1048 can be raised over the top end of the side wall 1030, by which the fastening element 1022A and 1022B can be suspended in the first trough-shaped part 1026.

Figure 15:
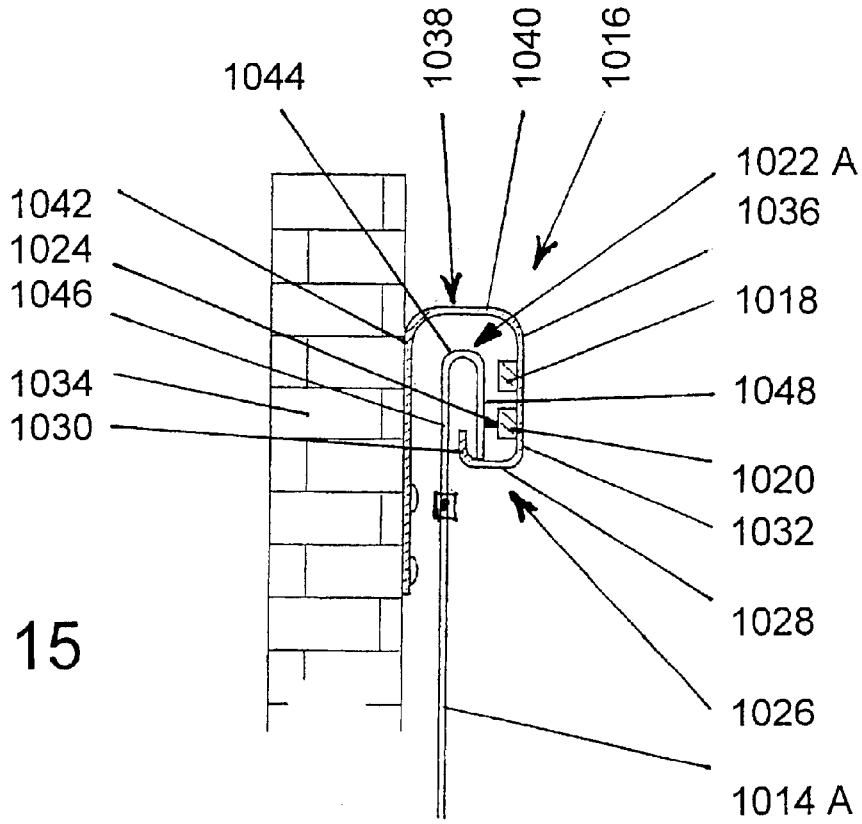
FIGS. 15 and 16, show a sectional view at different sites of the hanging device from FIG. 19.
Figure 16:
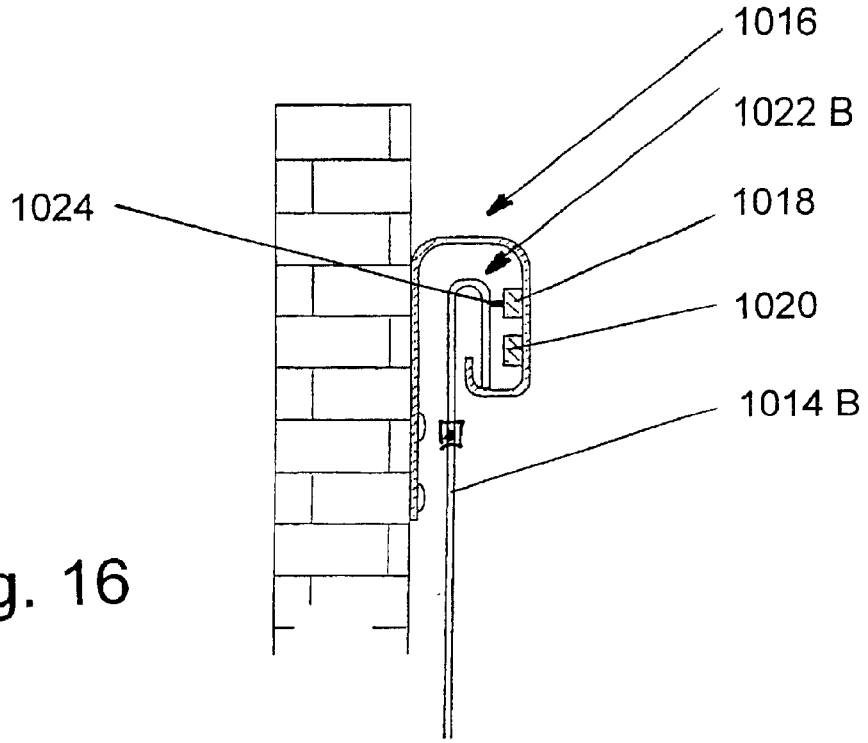

The hanging device as shown in FIGS. 15 and 16 can be produced very economically, and is visually attractive and user-friendly. The fastening elements 1022A and 1022B can be optionally moved in the first trough-shaped part 1026 along the fastening unit 1016 without interrupting electrical contact to the current paths 1018 and 1020. This allows flexible adjustment of the suspension part of the corresponding picture 1010.

Figure 17:
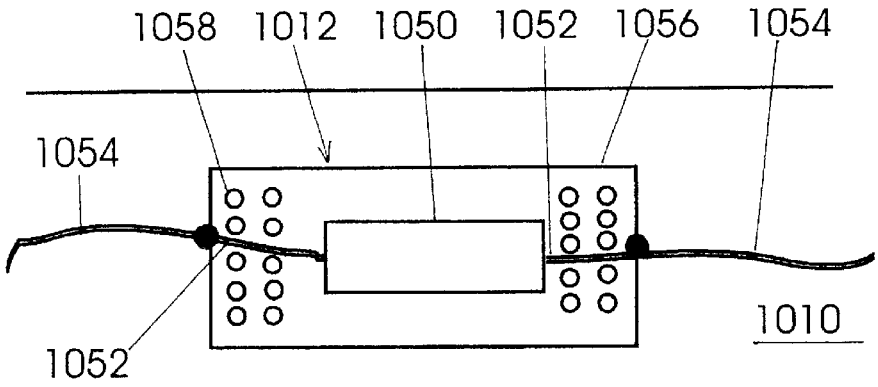
FIG. 17 shows an overhead view of the monitoring unit in accordance with the invention in a first embodiment which is attached to the article to be monitored.

As already mentioned, each picture 1010 on its back is provided with an electronic monitoring unit 1012 as show in FIG. 17. The monitoring unit 1012 comprises a monitoring element 1050 which is made as a transponder and which is connected by means of connection lines 1052 to two terminals 1054 which in turn are in electrical contact with the cable 1014A and 1014B. Furthermore, the monitoring unit 1012 comprises an elastic film 1056 to which the transponder 1050 and the connection lines 1052 are permanently and undetachably connected and which on its back comprises an adhesive layer for cementing the monitoring unit 1012 to the back of the picture 1010. The film 1056 is made with respect to its material, its thickness and its elasticity, such that it tears away from the picture 1010 upon attempted mechanical detachment in the cemented state. The film 1056 is provided with perforations 1058 to intensify this effect.

The transponder 1050 and the connection lines 1052 are preferably fabricated or printed on the film 1056 or are welded into the film 1056.

The monitoring system is made such that the control unit is electrically connected via the current paths 1018 and 1020 of the fastening unit 1016 and via the hanging cables 1014A and 1014B to each individual transponder 1050. In the simplest case the transponder 1050 is a resistor, an individual resistance value being assigned to each picture 1010 and all resistors being arranged in a parallel connection.

Figure 19:
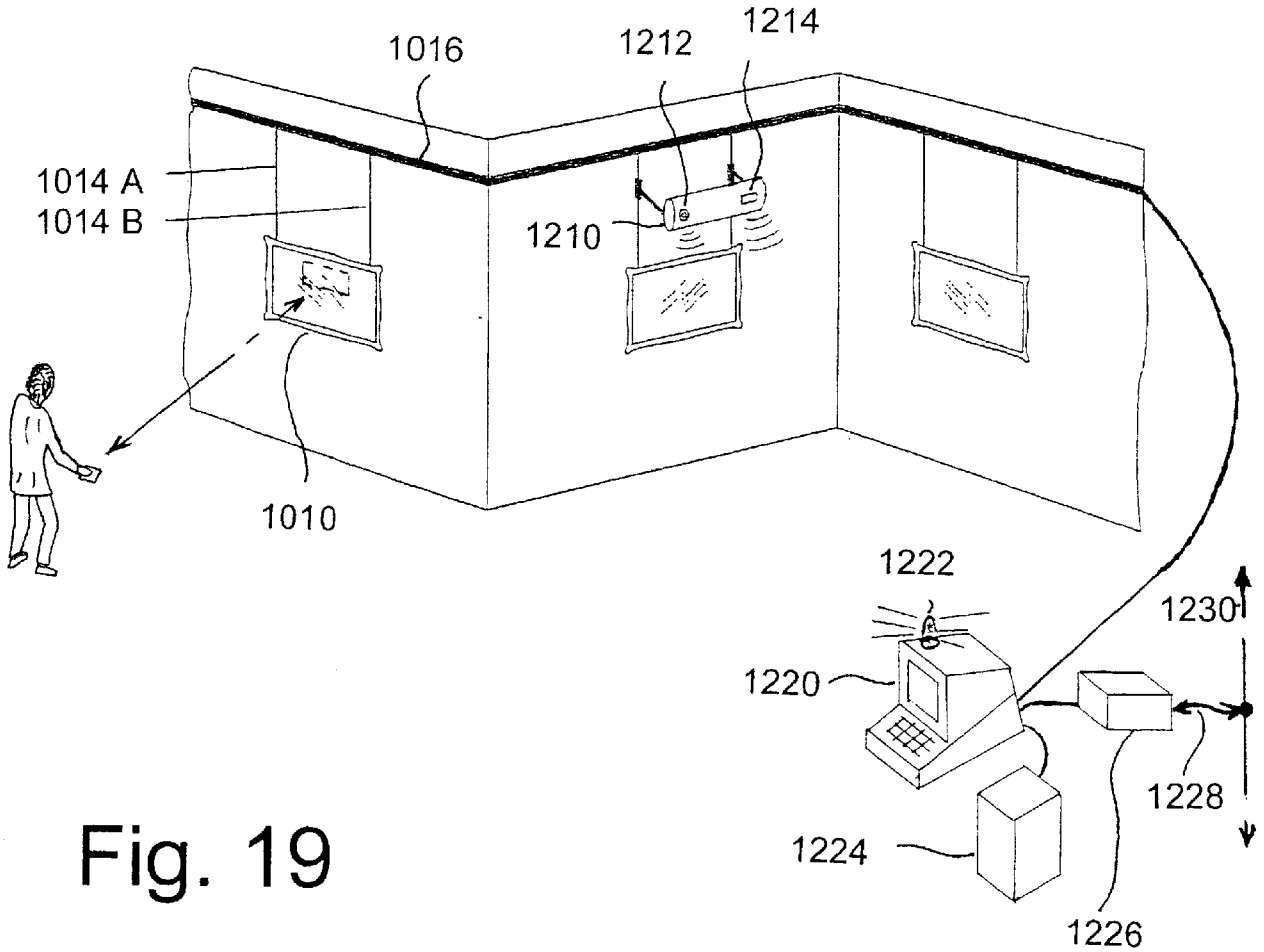
FIG. 19 shows an overall schematic view of another hanging device in accordance with the invention in cooperation with the monitoring system of the invention.

The control unit 1220 as show in FIG. 19 (or 20, 120) then acquires the current through the entire loop formed by the parallel connection and upon deviations from a stipulated setpoint, produces an alarm signal. The transponder 1050 however can also be made as a digital logic unit which identifies the corresponding picture 1010 by means of a digital code value which is delivered only once and which is fixed by digital memory, dip switches, wire bridges and the like on the logic unit. In this case, monitoring takes place such that the control unit via the current paths 1018 and 1020 and the suspension cables 1014A and 1014B sends signals to the transponder 1050 which are acknowledged by it with a specially assigned code value. The absence of an acknowledgement signal on the control unit leads to generation of a corresponding alarm signal. In doing so the specially affected picture can be identified.

The alarm signal is therefore triggered as soon as the electrical connection between the control unit and the transponder 1050 is interrupted in some way. This can take place, for example, by a cable 1014A or 1014B, i.e. the corresponding fastening element 1022A or 1022B, being removed from the fastening unit 1016 or an attempt being made to detach the monitoring unit 1012 as a whole from the picture 1010. In an attempt to detach the cemented film 1056 from the back of the picture 1010, the film 1056 tears, for example along the perforations 1058, resulting in at least one of the connection lines 1052 being interrupted or the transponder 1050 itself being damaged. The resulting interruption of the electrical connection between the control unit and the transponder 1050 causes a corresponding alarm signal to be produced on the control unit.

Additionally or alternatively to the monitoring unit 1012 on the back of the pictures 1010, there can be a motion detector for each picture which sends a corresponding signal to the control unit when suspicious movements occur. A comparable motion detector 1214 can however also be integrated advantageously into an illumination unit 1210, as is shown in FIG. 19.

The control unit is made such that when a specific signal from one of the transponders 1050 is absent and/or when an alarm signal is acquired from one of the motion detectors, the control unit identifies the corresponding picture. The control unit forms part of the monitoring system which furthermore comprises a display means and a memory in which graphic displays of the individual pictures 1010 are stored. The control unit is made such that after determining the picture 1010 which has been affected by the alarm situation, it causes graphic display of the corresponding picture 1010 from the memory (1224, FIG. 19) on the display means such that the monitoring individual can immediately recognize which picture is affected. In addition to the graphic display of the affected picture, additional information can be displayed, such as for example, the room number and an identification number which is assigned to the picture. In addition, a general alarm can be given at the same time by means of a sensor 1222 (FIG. 19), locally or at different sites.

Furthermore, there can be surveillance cameras (for example cameras 1212 integrated into an illumination unit 1210) for the pictures, and one surveillance camera can be assigned to one or more pictures at a time. The monitoring system can then be made such that when a specific signal from one of the transponders 1050 is absent and/or when an alarm signal is acquired from one of the motion detectors, video signals of the surveillance camera assigned to the affected picture are additionally displayed on the display means. Furthermore, video signals of the affected surveillance camera can be stored for a certain time interval which can be for example, several days. Storage can proceed such that the video signals for one individual picture at a time from the surveillance camera are stored at given intervals, for example at an interval of one second. The stored images can be overwritten, for example, after roughly 10 days. In a special configuration of the invention, the surveillance cameras are integrated into the illumination elements and can acquire the entire area of an article to be monitored. A serial data transmission format similar to the so-called USB standard can be used for data transmission so that even several cameras can be operated on the available current leads or signal leads.

Furthermore, there can be acoustic sensors 1214 in the vicinity of the picturers, so that when a specific signal from one of the transponders 1050 is absent and/or when an alarm signal is acquired from one of the motion detectors, the signals of the acoustic sensor assigned to the affected picture is recorded in a similar manner as in the signals of the surveillance camera and is temporarily stored.

There can be several control units 1220 which are wired such that they can be used individually or simultaneously, and the control units can be interconnected for example, via modems 1226 and the pertinent network connections 1228, 1230 to a computer network. In this way, several surveillance stations can be formed which are interconnected. The computer network can be made for example, as an intranet or it can be formed via Internet connections. Preferably, the monitoring system can be remotely controlled, the remote control can take place for example, by means of a modem 1226 and telephone system or by means of a direct digital network connection.

Furthermore, a control unit can also form several connected workstations by there being several display means, for example, in the form of so-called terminals.

Figure 18:
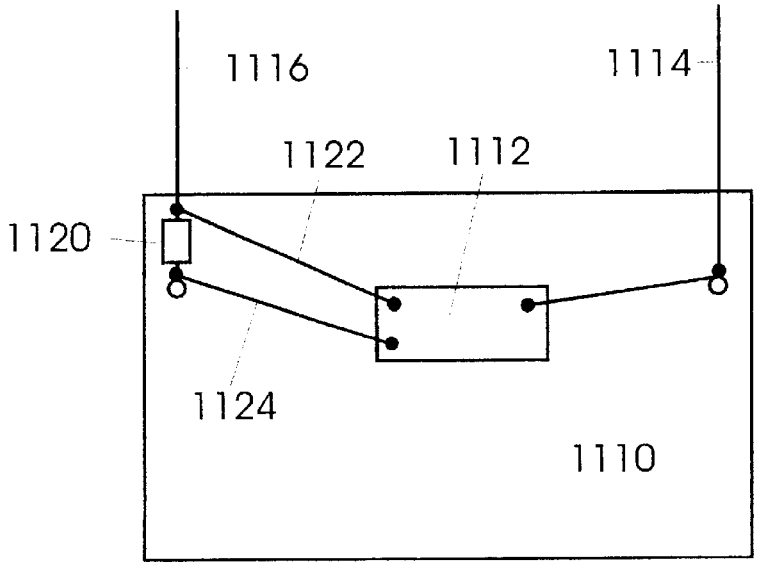
FIG. 18 shows a back view of a second embodiment of the monitoring unit in accordance with the invention.

FIG. 18 which shows the rear view of a picture 1110 which is to be suspended and monitored illustrates another embodiment of an electronic monitoring unit 1112 which is attached on the back of the picture 1110. The picture 1110 is hung with two cables 1114 and 1116 which are also used as an electrical communications link between the monitoring unit 1112 and a central control unit (which is not shown) by their being made electrically conductive. A strain gauge 1120 is integrated into the cable 116 and it replaces a cable section and acquires the load on the cable 1116 by the picture 1110. The monitoring unit 1112 is electrically connected via terminals 1122, 1124 to the strain gauge 1120 in order to acquire the electrical signal which corresponds to the current load on the cable 1116. As soon as this load signal departs from a stipulated fluctuation range, the monitoring unit 1112 delivers an alarm signal to the control unit since then a theft or the like can be expected.

In another embodiment of the invention, there are monitoring units which operate repeatedly and independently of one another. Accordingly, one monitoring unit on the one hand can be incorporated by wire into a monitoring system, or this can be done wirelessly. But provisions can also be made for a second monitoring system, in addition to the first, for individual or all monitoring units, which works independently of the first. To do this, it is proposed that the monitoring units be expanded such that for example, they have inductively operating secondary transponders which can be interrogated by an independent and mobile control entity in inspections which are carried out occasionally and essentially incognito, so that the existence and functionality of the provided monitoring units can be verified.

What is claimed is:

1. A hanging device for establishing an electrically conductive contact with at least one hanging article comprising:

an elongated fastening unit adapted to be attached to a stationary surface, said fastening unit including at least two current paths; and at least one fastening element movably mounted to said fastening unit, said at least one fastening element being adapted to suspend said at least one hanging article along said stationary surface;

wherein said at least one fastening element is provided with at least one contact which establishes said electrically conductive contact with at least one of said at least two current paths.

2. The hanging device of claim 1, wherein said electrically conductive contact between said at least one contact and said at least one of said at least two current paths is maintained when said at least one fastening element is moved on said fastening unit.

3. The hanging device of claim 1, wherein said at least one fastening element is adjustable to selectively establish electrically conductive contact with one of said at least two current paths.

4. The hanging device of claim 1, further comprising:

an electronic monitoring element;

at least two terminals electrically connected to said electronic monitoring element via connection lines; and electrical feed lines electrically connected to said at least two terminals;

wherein said electronic monitoring element and said connection lines are permanently attached to a surface of a film, said film including an adhesive layer for cementing said monitoring unit onto a hanging article to be monitored, said film being adapted to tear away from the article when the hanging article is moved away from a predetermined location.

5. The hanging device of claim 4, wherein said film is provided with perforations.

6. The hanging device of claim 4, wherein said monitoring element is an electrical circuit fabricated on said film together with said connection lines.

7. The hanging device of claim 4, wherein said connection lines and said electronic monitoring element are printed circuit paths.

8. The hanging device of claim 7, wherein said monitoring element is a resistor.

9. The hanging device of claim 4, wherein said monitoring element is a logic unit.

10. The hanging device of claim 4, wherein the hanging article to be monitored is at least one of a picture and a painting, and said monitoring unit is cemented onto a back surface of said hanging article.

11. The hanging device of claim 1, further comprising:

at least one control unit which includes at least one display means and a memory which stores graphic representations of a plurality of hanging articles to be monitored;

a plurality of monitoring elements, each of said plurality of monitoring elements being assigned to a corresponding hanging article and being adapted to detect a breach in security of said corresponding hanging article, each of said plurality of monitoring elements also being in a communicational link with said at least one control unit to provide information to said at least one control unit that is correlated to the breach in security of said corresponding hanging article;

wherein said at least one control unit is adapted to identify and graphically display from said memory on said display means, a graphic representation of said corresponding article upon receiving information of breach in security from a monitoring element assigned to said corresponding article.

12. The hanging device of claim 11, wherein a breach in security of a hanging article is determined by a breach signal from an assigned monitoring element.

13. The hanging device of claim 11, wherein a breach in security of a hanging article is determined by an absence of a predetermined signal from a monitoring element.

14. The hanging device of claim 11, wherein said at least one control unit is adapted to also display on said display means, a location and an identification number of said corresponding article for which breach in security has been detected.

15. The hanging device of claim 11, wherein the plurality of articles are exhibited works of art and each monitoring element is attached to the rear of a work of art.

16. The hanging device of claim 11, wherein the at least one control unit further includes at least one surveillance camera for monitoring the plurality of hanging articles.

17. The hanging device of claim 16, wherein the at least one control unit further includes a plurality of surveillance cameras assigned to a corresponding hanging article being monitored, wherein said at least one control unit is adapted to also display on said display means, a video signal from a corresponding surveillance camera upon receiving information of breach in security from a monitoring element assigned to said corresponding article.

18. The hanging device of claim 16, wherein the memory of said at least one control unit is adapted to also store a video signal from said surveillance camera for a predetermined time interval when a breach in security has been detected.

19. The hanging device of claim 18, wherein said predetermined time interval is several days.

20. The hanging device of claim 17, wherein the memory of said at least one control unit is adapted to store a video signal from each of said plurality of surveillance cameras for each of the corresponding hanging articles for a predetermined time interval.

21. The hanging device of claim 11, further including at least one acoustic sensor proximate to the plurality of hanging articles to record any sound when a breach in security is detected.

22. The hanging device of claim 11, wherein said at least one control unit comprises a plurality of control units interconnected to one another to form a network.

23. The hanging device of claim 22, wherein each of said plurality of control units are independently operable.

24. The hanging device of claim 22, wherein said network is an intranet.

25. The hanging device of claim 22, wherein said network is formed by means of internet connections.

26. The hanging device of claim 11, wherein said at least one control unit is remotely controllable.

27. The hanging device of claim 26, further including at least one of a direct digital connection and a modem for remotely controlling said at least one control unit.

28. The hanging device of claim 11, further comprising:

a plurality of hanging elements for hanging said plurality of hanging articles, wherein each hanging element includes a force sensor assigned to one of the hanging articles for sensing a load exerted by the assigned hanging article and for providing an electrical signal corresponding to said load;

a plurality of electronic monitoring units wherein each electronic monitoring unit is attached to a back surface of the hanging articles, and each said electronic monitoring unit is electrically connected to a force sensor assigned to the hanging article to receive said electrical signal corresponding to said load;

wherein each electronic monitoring unit is adapted to provide a security breach information to said at least one control unit when said electrical signal corresponding to said load deviates from a predetermined fluctuation range.

29. The hanging device of claim 28, wherein said plurality of hanging elements are cables and said force sensor is a strain gauge disposed between sections of said cables.

30. The hanging device of claim 28, wherein said plurality of hanging articles are pictures which are each suspended by means of two cables at a time, said force sensor being integrated into one of said two cables.

31. The hanging device of claim 11, further comprising:

a sensor for monitoring the distance of the suspended article from the wall, said sensor being adapted to deliver a signal when the distance of the suspended article from the wall departs from a predetermined tolerance range;

wherein said sensor is at least one of a capacitive sensor and an optical sensor.

32. The hanging device of claim 31, wherein said sensor is an optical sensor which sends a light beam to the wall and detects light reflected off the wall.

33. The hanging device of claim 1, further comprising:

a first and second monitoring means wherein the first monitoring means communicates with a first, permanently installed monitoring system, and also communicates with the second monitoring means and wherein the second monitoring means exchanges information with a second mobile monitoring system.

34. The hanging device of claim 33, wherein said second monitoring means is a transponder.

35. A hanging device for establishing an electrically conductive contact with at least one hanging article comprising:

an elongated fastening unit adapted to be attached to a stationary surface, said fastening unit including at least two current paths; and at least one fastening element mountable to said fastening unit, said at least one fastening element being adapted to suspend said at least one hanging article along said stationary surface;

wherein said at least one fastening element is provided with at least one contact which is adjustable to selectively establish said electrically conductive contact with at least one of said at least two current paths.

36. The hanging device of claim 35, wherein said electrically conductive contact between said at least one contact and said one of said at least two current paths is maintained when said at least one fastening element is moved on said fastening unit.

37. The hanging device of claim 35, wherein an adjustment to selectively establish said electrically conductive contact with said at least one of said at least two current paths is made by an orientation of mounting of said at least one fastening element to said fastening unit.

38. The hanging device of claim 35, wherein said at least one fastening element is shaped essentially mirror-syrnmetrically with reference to a center plane.

39. The hanging device of claim 38, wherein said fastening unit is shaped essentially mirror-symmetrically with reference to a center plane.

40. The hanging device of claim 39, wherein said fastening element is adapted to be mounted to said fastening unit in a first contact configuration and in a second contact configuration in which said fastening element is rotated by 180° relative to said first contact configuration.

41. The hanging device of claim 40, wherein said fastening unit includes two current paths and said at least one contact contacts one of said two current paths in said first contact configuration, and makes contact with the other current path in said second contact configuration.

42. The hanging device of claim 35, wherein said at least one contact is attached permanently to said at least one fastening element.

43. The hanging device of claim 35, wherein an adjustment to selectively establish said electrically conductive contact with said at least one of said at least two current paths is made by selectively attaching one of at least two types of contacts to said fastening element.

44. The hanging device of claim 35, wherein said fastening unit is shaped as a rail.

45. The hanging device of claim 44, wherein said fastening unit includes a profile part which partially encompasses an interior, said at least two current paths are busbars which are attached on said profile part in said interior.

46. The hanging device of claim 45, wherein said profile part is electrically insulating.

47. The hanging device of claim 45, wherein said at least one contact is a brush spring which presses on one of said busbars.

48. The hanging device of claim 45, wherein said profile part is channel-shaped with three essentially closed sides and one open side which has been provided with a through, elongated opening, said at least one fastening element being mounted at least partially in said profile part through said elongated opening.

49. The hanging device of claim 48, wherein said at least one fastening element is guided in a lengthwise direction by boundary edges of said elongated opening.

50. The hanging device of claim 49, wherein said boundary edges of said elongated opening are each provided with a slot in said lengthwise direction into which a side edge of said at least one fastening element is received, said at least one fastening element being guided by said side edge received in said slot.

51. The hanging device of claim 45, wherein said profile part is channel-shaped with a back side, a top side, a bottom side and one open side, said profile part being attached to a wall by said back side, and said open a front being formed by said top side and said bottom side, said top side including a first slot and said bottom side including a second slot, and wherein said at least one fastening element is adapted to be mounted by said first slot and engaged at a bottom end by said second slot.

52. The hanging device of claim 48, further comprising a diaphragm part adapted for insertion into said elongated opening of said profile part.

53. The hanging device of claim 52, wherein said diaphragm part includes contact that establish electrically conductive contact with said at least two current paths and includes an electronic means which is conductively connected to said contacts.

54. The hanging device of claim 35, wherein said fastening unit includes a plurality of holding elements adapted to be attached in a row and also includes at least two parallel tubular current leads, said at least two parallel current leads being held by said plurality of holding elements.

55. The hanging device of claim 54, wherein said at least one contact establishes said electrically conductive contact with at least one of said at least two parallel current leads.

56. The hanging device of claim 55, further including an insulated auxiliary element positioned substantially symmetrically to said at least one contact, said insulated auxiliary element being adapted to support one of said at least two parallel current leads.

57. The hanging device of claim 35, wherein said at least one hanging article is a work of art which is provided with at least one of an electrical security and an illumination means.

58. The hanging device of claim 35, wherein said at least one fastening element includes at least one of an eyelet and a hook for suspending a hanging element which is connected to said at least one hanging article to be hung, said hanging element being electrically conductively connected to said at least one contact.

59. A hanging device for establishing an electrically conductive contact with at least one hanging article comprising:

an elongated fastening unit adapted to be attached to a stationary surface, said fastening unit including at least two current paths; and at least one fastening element movably mounted to said fastening unit, said at least one fastening element being adapted to suspend said at least one hanging article along said stationary surface and being provided with at least one contact which is adjustable to selectively establish said electrically conductive contact with at least one of said at least two current paths;

wherein said fastening unit includes a first trough-shaped part with a base and two side walls, and said at least one fastening element includes a downwardly opened U-shaped part with a base and two legs, a free end of a first leg being mechanically connected to the hanging article and a free end of a second leg being hung in said first trough-shaped part of said fastening unit.

60. The hanging device of claim 59, wherein a first wall of said two side walls is positioned away from the stationary surface and extends to an upper base which lies above said at least one of said two side walls, said upper base being attached to a side wall adapted to be attached to the stationary surface in a manner that said first trough-shaped part is pointed towards said stationary surface, and wherein said downwardly opened U-shaped part is received underneath said upper base.

61. The hanging device of claim 60, wherein an inside surface of said first wall of said two side walls is provided with a plurality of current paths.

62. The hanging device of claim 59, wherein said first leg of said fastening element is supported on said base of said first trough-shaped part.

63. The hanging device of claim 59, wherein one of said two side walls of the first trough-shaped part is adapted to be attached to the stationary surface.

64. The hanging device of claim 59, further including at least one hanging element made of at least one of a cable and a chain which is fixedly attached to the hanging article.

65. A hanging system for suspending and establishing an electrically conductive contact with at least one hanging article comprising:

an elongated fastening unit adapted to be attached to a stationary surface, said fastening unit including at least two current paths;

at least one hanging element mountable to said fastening unit in electrical contact with at least one of said two current paths, said at least one hanging element being adapted to suspend said at least one hanging article said fastening unit along said stationary surface and to provide an electrical connection between said at least one hanging article and said at least one of said two current paths; and illumination means for illuminating said at least one hanging article, said illumination means being electrically connected to at least one of said two current paths.

66. A hanging system according to claim 65, wherein said illumination means is directly electrically connected to at least one of said two current paths.

67. A hanging system according to claim 66, wherein said fastening unit comprises at least one rail with said current paths thereon and wherein said illumination means has attachment means for mechanically mounting thereof to the at least one rail and thereby electrically connecting the illumination means to said at least one of said two current paths.

68. A hanging system according to claim 65, wherein said illumination means is electrically connected to at least one of said two current paths via said hanging element.

69. A hanging system according to claim 68, wherein hanging element comprises at least one electrically conductive wire and said illumination means has means for mechanically mounting thereof to the said at least one electrically conductive wire and thereby electrically connecting the illumination means to said at least one of said two current paths via said electrical connection of the illumination means to at least one electrically conductive wire.

* * * * *

UNITED STATES PATENT AND TRADEMARK OFFICE

CERTIFICATE OF CORRECTION

PATENT NO. : 6,686,841 B1
DATED : February 3, 2004
INVENTOR(S) : Dieter Busch et al.

It is certified that error appears in the above-identified patent and that said Letters Patent is hereby corrected as shown below:

Title page,
Item [75], Inventors, delete "Miachael Hermann, Villingen (DE)" insert -- Michael Hermann, Villingen (DE) --;

Signed and Sealed this

Fifteenth Day of June, 2004

JON W. DUDAS
*Acting Director of the United States Patent and Trademark Office*